US006076684A

United States Patent [19]

Bollegraaf

[11] Patent Number: 6,076,684

[45] Date of Patent: Jun. 20, 2000

[54] WASTE PAPER SORTING CONVEYOR FOR SORTING WASTE PAPER FORM WASTE CARDBOARD

[75] Inventor: Heiman Salle Bollegraaf, Groningen, Netherlands

[73] Assignee: Machine Fabriek Bollegraaf Appingedam B.V., Appingedam, Netherlands

[21] Appl. No.: 08/728,288

[22] Filed: Oct. 8, 1996

[30] Foreign Application Priority Data

Sep. 18, 1996 [EP] European Pat. Off. ..... 96202605

[51] Int. Cl.[7] ..... B07B 13/04

[52] U.S. Cl. ..... 209/668; 209/672

[58] Field of Search ..... 209/659, 660, 209/667, 668, 671, 672, 930

[56] References Cited

U.S. PATENT DOCUMENTS

| | | | |
|---|---|---|---|
| 1,679,593 | 8/1928 | Williamson et al. | 209/672 |
| 3,519,129 | 7/1970 | Peterson | 209/671 |
| 4,600,106 | 7/1986 | Minardi | 209/668 X |
| 4,795,036 | 1/1989 | Williams | 209/672 X |
| 5,060,806 | 10/1991 | Savage | 209/672 X |
| 5,450,966 | 9/1995 | Clark et al. | 209/668 X |
| 5,484,247 | 1/1996 | Clark et al. | 414/412 |

FOREIGN PATENT DOCUMENTS

| | | | |
|---|---|---|---|
| 89 06 721 | 8/1989 | Germany . | |
| 2015911 | 4/1990 | Germany . | |
| 9001005 | 11/1991 | Netherlands . | |
| 2222787 | 3/1990 | United Kingdom | 209/668 |
| WO 95/35168 | 12/1995 | WIPO . | |

OTHER PUBLICATIONS

Exhibit 1: Machinefabriek Bollegraaf Appingedam B.V. Order confirmation outlining the specification for a separator from D&D Recycling in Dallas, Texas, Nov. 10, 1993.

Exhibit 2: Brochure from B.H.S. Handling systems, Inc. depicting paper separator.

Exhibit 3: Lubo B.V. order outlining the specification for a cardboard paper sorter (with translation), Jan. 3, 1993.

*Primary Examiner*—Tuan N. Nguyen

*Attorney, Agent, or Firm*—Merchant & Gould P.C.

[57] ABSTRACT

A waste paper sorting conveyor for sorting waste paper from waste cardboard has a sorting bed formed by a row of rotatable, driven shafts mutually spaced in a conveying direction and each extending transversely to the conveying direction. The shafts each carry a row of impellers for intermittently urging material on the sorting conveyor upward and in the conveying direction. The impellers of each of the rows are mutually spaced in longitudinal direction of the respective shaft. Rotary contours of impellers carried by each of the shafts project between rotary contours of the impellers carried by a neighboring one of the shafts. Since the mutual spacing of the impellers of at least one of the rows in longitudinal direction of the respective shaft is adjustable, waste paper and waste cardboard mixtures of varying compositions can be sorted to an improved purity.

17 Claims, 5 Drawing Sheets

WASTE PAPER SORTING CONVEYOR FOR SORTING WASTE PAPER FORM WASTE CARDBOARD

TECHNICAL FIELD

Waste paper and waste cardboard are generally collected in mixed form. For the sake of recycling, however, it is preferred to separate typically brown cardboard from waste paper, because inclusion of substantial amounts of waste cardboard in raw material from which paper is to be made results in relatively gray or brown paper. The invention relates to an apparatus for sorting waste paper from waste cardboard.

BACKGROUND ART

From practice, a waste paper sorting conveyor for sorting waste paper from waste cardboard is known, which comprises a row of rotatable, driven shafts mutually spaced in a conveying direction and each extending transversely to the conveying direction. The shafts each carry a row of radially extending impelling members for intermittently urging material on the sorting conveyor upward and in the conveying direction. The impellers of each of the rows are mutually spaced in longitudinal direction of the respective shaft. Rotary contours of impellers carried by each of the shafts project between rotary contours of the impellers carried by a neighboring one of the shafts.

In operation, a mixture of waste paper and waste cardboard is fed to the upstream end of the sorting conveyor. Rotary motion of the impellers intermittently urges the material on the conveyor upward and forward in conveying direction. Thus, the material on the conveyor is simultaneously shaken and transported along the conveyor. Since paper in the mixture is typically of a smaller size and more flexible than cardboard, paper on the conveyor tends to fall through interspaces between the shafts and the impellers, while cardboard tends to remain on top of the conveyor. Thus, material predominantly consisting of cardboard can be collected at the downstream end of the conveyor or succession of conveyors, and material predominantly consisting of paper can be collected from under the conveyor.

A problem of this known sorting conveyor is that in most cases it does not yield a satisfactory degree of sorting. Either too much paper is included in the sorted cardboard and/or too much cardboard is included in the sorted paper.

SUMMARY OF THE INVENTION

It is an object of the present invention to provide a sorting conveyor with which a more generally satisfactory degree of sorting can be achieved.

According to the invention, this object is achieved by providing a sorting conveyor of the above-described type in which the mutual spacing between the impellers of at least one of the rows in longitudinal direction of the respective shaft is adjustable.

By increasing the size of the spacings, material of a generally larger maximum size and stiffness is allowed to fall through the interspace. By decreasing the size of the spacings, material of a generally smaller minimum size and stiffness is precluded from falling through the interspace. Thus, the sorting properties can be accurately adjusted to the composition of the mixture of waste material fed to the sorting conveyor, the demand for waste paper and waste cardboard, and any requirements regarding the maximum and minimum proportion of paper in the sorted cardboard and, conversely, regarding the maximum and minimum proportion of cardboard in the sorted paper.

It has been found, for example, that the composition of paper and cardboard waste in urban areas is substantially different from the composition of the same type of waste in rural areas. It has also been found that the composition varies from country to country, major factors determining the structure of the paper and cardboard waste being the thickness and size distribution of newspapers and magazines and the type of cardboard typically used. Furthermore, in some instances, waste cardboard including about 10% waste paper is required. Instead of simply adding paper to the waste cardboard after sorting, such a composition can be obtained more efficiently using the sorting apparatus according to the invention by narrowing the spacings so that the desired composition is obtained directly. As an advantageous side effect, the degree to which the sorted paper includes cardboard impurities is then reduced.

A further improved adjustability of the sorting conveyor to variations in the composition of paper and cardboard material to be sorted can be obtained by providing that the position of at least one of the shafts in conveying direction is adjustable as well.

A still further improved adjustability of the sorting conveyor to variations in the composition of paper and cardboard material to be sorted can be obtained by providing that the rotational velocity of the impellers is adjustable as well. In particular, if the combination of spacing in conveying direction and rotational velocity of the impellers is independently adjustable in at least two sections of the conveyor, a substantially improved degree of purity of the sorted materials can be achieved over a wide range of compositions of paper and cardboard mixtures to be sorted.

Further objects, features and advantages of the present invention appear from the description set forth below, in which a preferred embodiment of the present invention is described with reference to the drawings. Particularly advantageous embodiments of the present invention are also described in the dependent claims.

MODES FOR CARRYING OUT THE INVENTION

Figure 1:
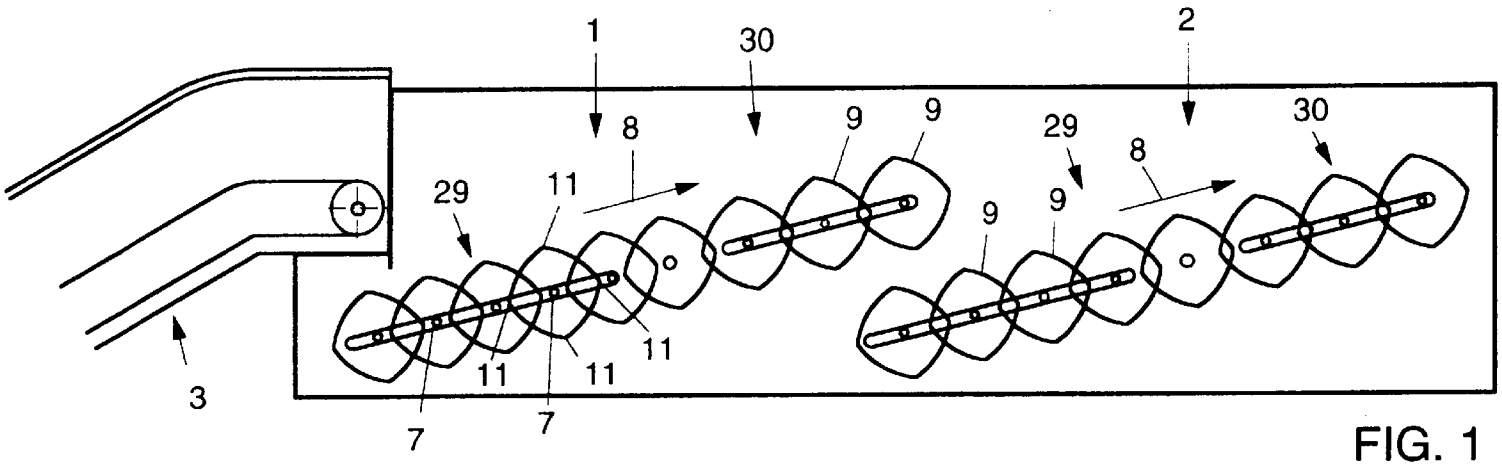
FIG. 1 is a schematic side view of a sorting conveyor system according to the present invention.
Figure 2:
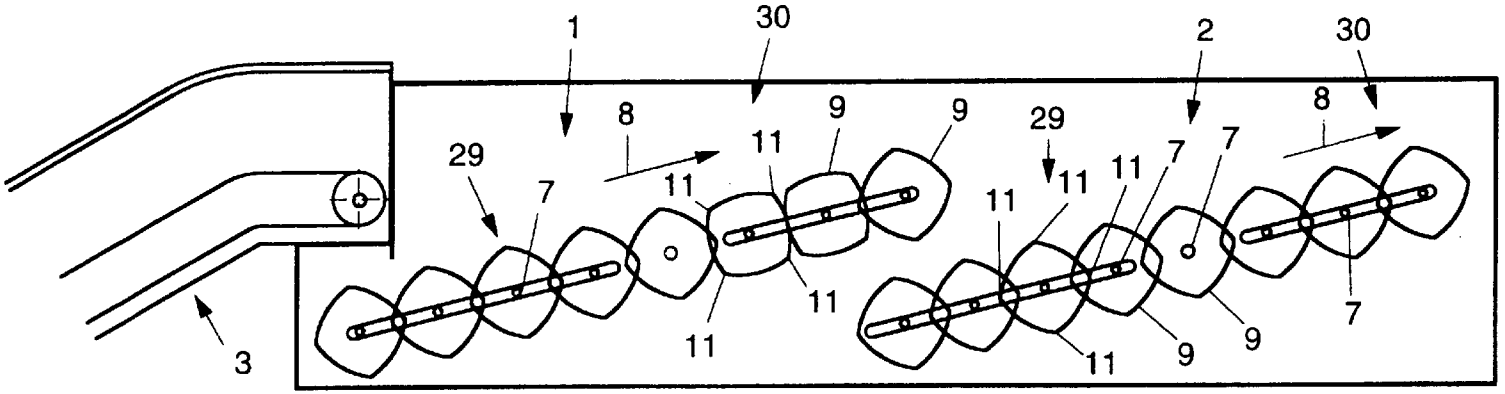
FIG. 2 is a side view of the sorting conveyor system shown in FIG. 1 in another setting.
Figure 3:
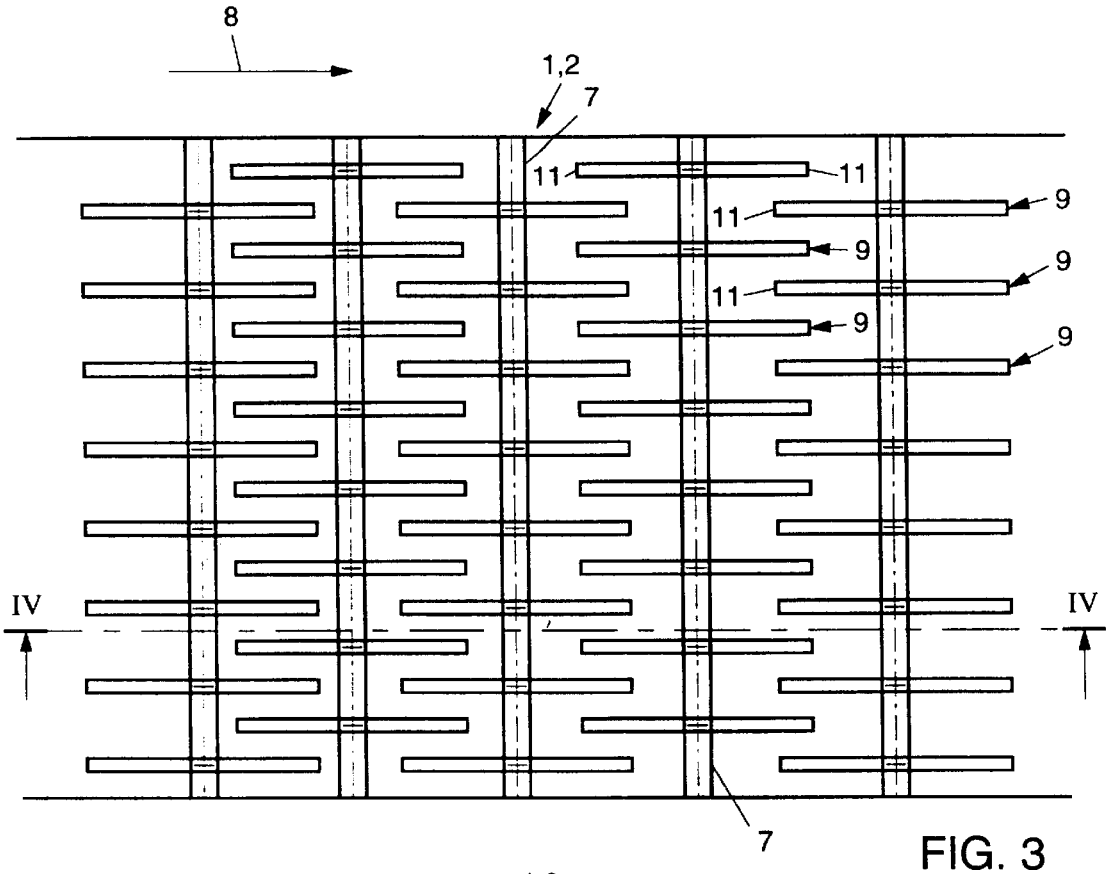
FIG. 3 is a schematic top plan view of a section of the sorting conveyor system according to FIG. 1.
Figure 6:
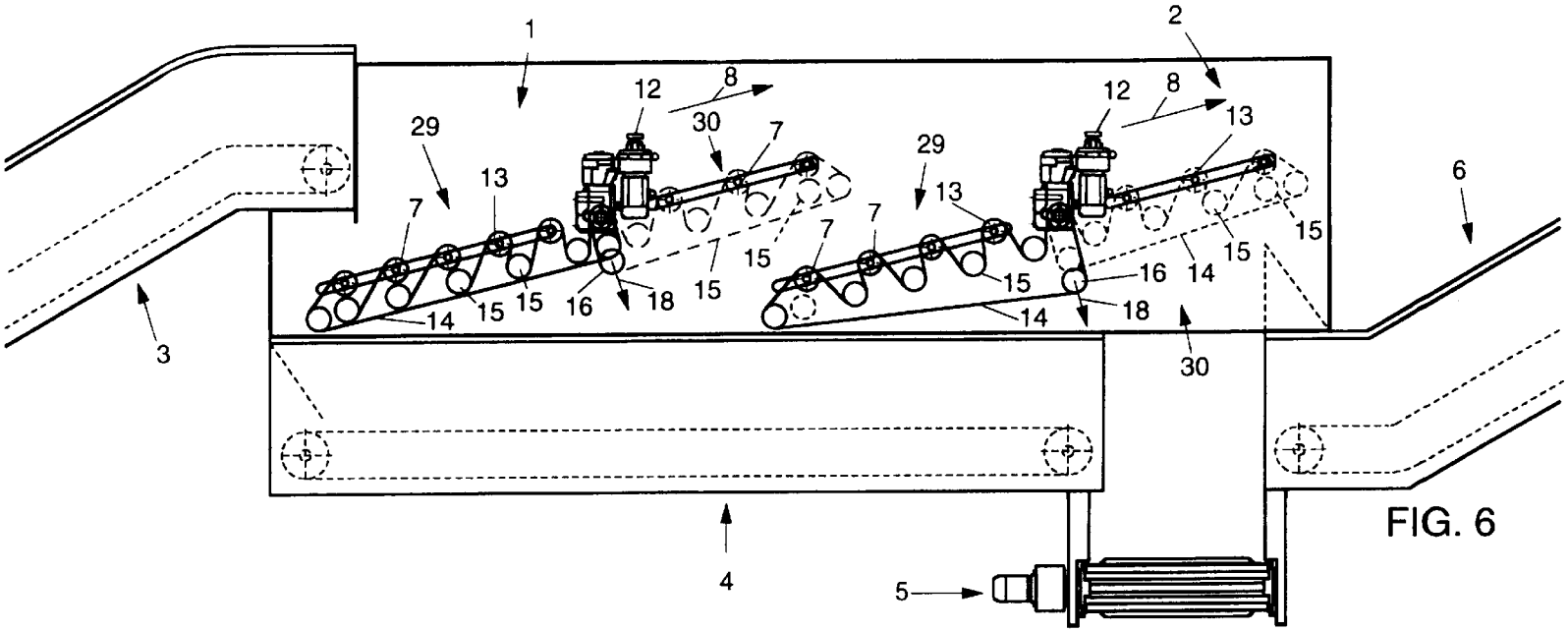
FIG. 6 is a view according to FIG. 1 showing the drive system and discharge means of the sorting conveyor system shown in FIGS. 1–5.

The waste paper sorting conveyor system shown in the drawing comprises two sorting conveyors 1, 2. The upstream conveyor 1 of the conveyors shown has a downstream end positioned above the upstream end of the downstream conveyor 2, so that material which has been passed over the upstream conveyor 1 is dropped onto the downstream conveyor 2. The system further includes a feeding conveyor 3 which is shown in FIGS. 1, 2 and 6 only, and discharge conveyors 4, 5, 6 shown in FIG. 6 only.

Figure 4:
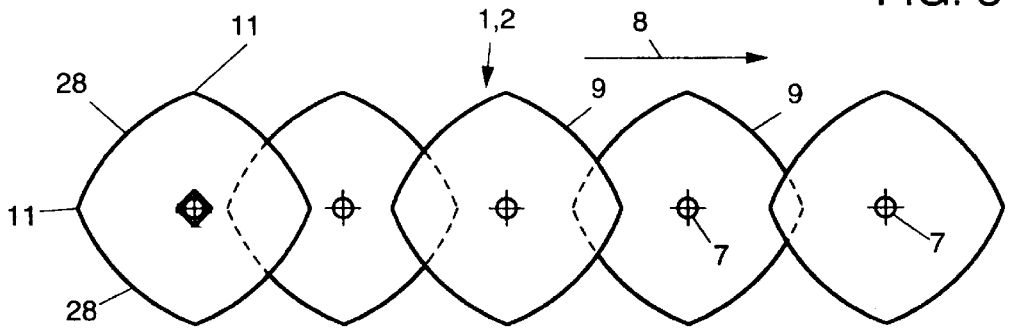
FIG. 4 is a side view in cross-section along the line IV—IV in FIG. 3.

The sorting conveyors 1, 2 are each provided with a row of rotatable, driven shafts 7 (not all shafts are designated by reference numerals). The shafts 7 are arranged in positions mutually spaced in a conveying direction (arrow 8) and each extend perpendicularly to the conveying direction. The shafts 7 each carry a row of radially extending impellers 9 (not all impelling members are designated by reference numerals) for intermittently urging material on the sorting conveyors 1, 2 upwards and in the conveying direction 8. The impellers 9 of each of the shafts 7 are mutually spaced in the longitudinal direction of the respective shaft 7 and rotary contours 10 (see FIGS. 4 and 5) of impellers 9 carried by each of the shafts 7 project between rotary contours 10' of the impellers 9 carried by a neighboring one of the shafts 7.

Figure 10:
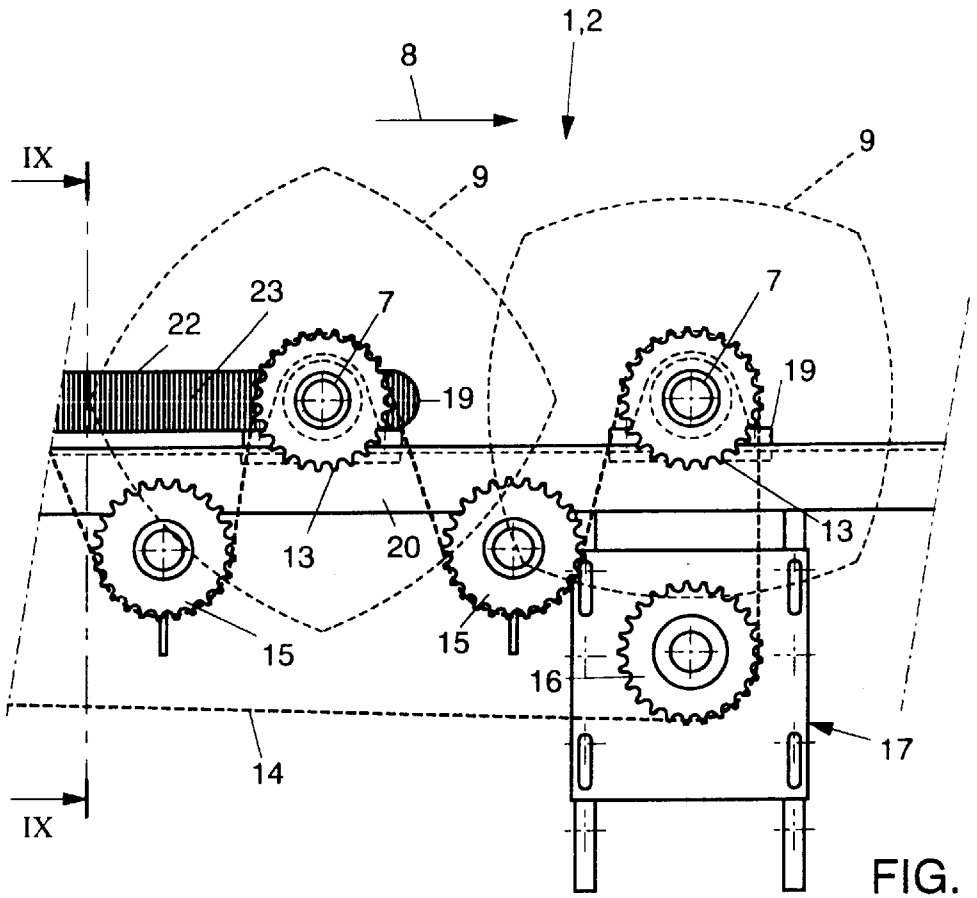
FIG. 10 is a detailed side view of a section of the sorting conveyor system shown in FIGS. 1–9.
Figure 9:
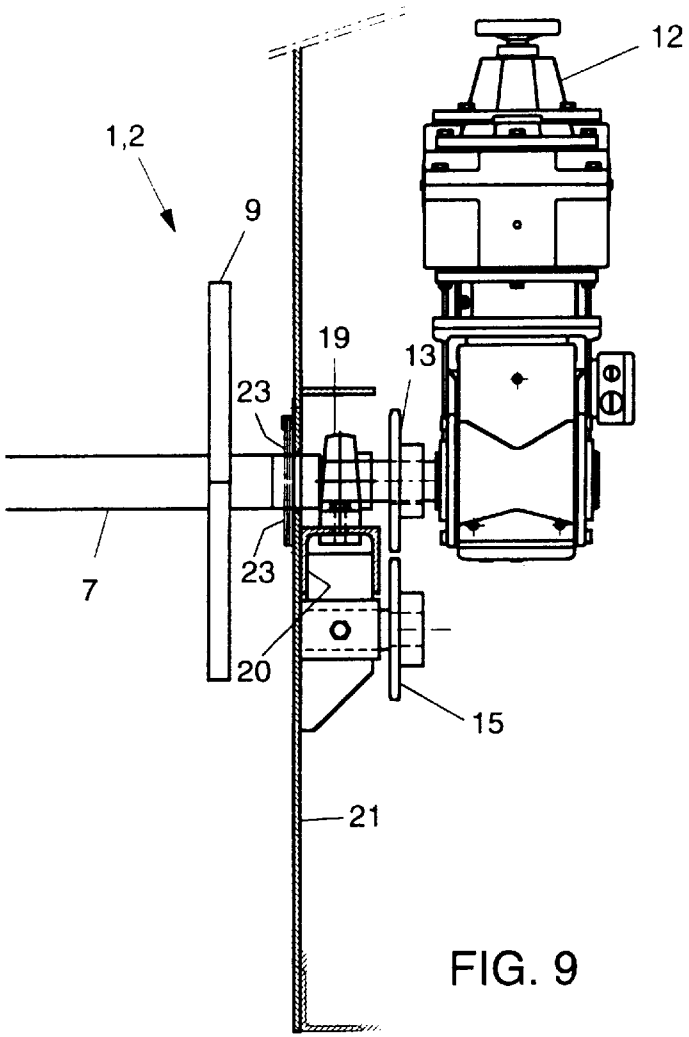
FIG. 9 is a detailed view in cross-section along the line IX—IX in FIG. 10.

The conveyors 1, 2 are further each provided with a motor-transmission unit 12 (FIGS. 6, 7 and 9) and transmission systems for driving the shafts 7. The transmission systems each include sprocket wheels 13 (not all sprocket wheels 13 are designated by reference numerals) mounted on the shafts 7, for transmitting driving forces exerted by the respective motor 12. The sprocket wheels 13 are engaged by a chain 14 (omitted in FIG. 9) which passes over the sprocket wheels 13, over divert wheels 15 (not all divert wheels 15 are designated by reference numerals) and over tensioning wheels 16. The tensioning wheels 16 are rotatably suspended from a tensioning structure 17 (FIG. 10) which is adapted for resiliently exerting a tensioning force in a direction indicated by arrows 18 in FIGS. 6 and 7. Chain tensioners are well known in the art and therefore not described in further detail.

In operation, material to be sorted is fed along the feeding conveyor 3. From there, the material is deposited onto the upstream sorting conveyor 1. The upstream sorting conveyor 1 transports the material in conveying direction 8 through rotation of the impellers 9 in conveying direction 8. Since the impellers include radially projecting parts, in this embodiment in the form of corners 11, the material on the conveyor 1 is simultaneously intermittently urged upwards and thereby agitated, which increases the likelihood that items sufficiently small and/or flexible to pass through open spaces in the conveyor 1 will eventually drop through the conveyor 1. Material that has not dropped through the conveyor 1 and has reached the downstream end thereof is dropped onto the downstream sorting conveyor 2, where the same sorting treatment is repeated. Dropping the material which is being sorted as it passes over the two conveyors 1, 2 provides the advantage that a very intensive additional agitation and mixing of the material is obtained, so that any paper items still lying on top of cardboard items are more likely to reach a position under cardboard material, allowing that paper item to fall through the second conveyor 2.

Material that has dropped through the conveyors 1, 2 (predominantly waste paper) is carried off along discharge conveyors 4, 5. Material that has also passed the downstream conveyor 2 without dropping through is dropped onto a third discharge conveyor 6 and carried off to another location. The mutual spacing of the impellers 9 of each shaft 7 in the longitudinal direction of that shaft 7 is adjustable. If, for example, the cardboard in a mixture includes relatively few small and flexible items, a wide spacing can be selected to achieve maximum paper yield without undue sacrifice of purity of the sorted paper waste. Conversely, if the waste paper includes relatively few large and stiff items such as books or other bound stacks of paper, a small spacing can be selected to achieve maximum paper purity without undue sacrifice of paper yield.

Other factors determining an optimum setting of the spacing between the impellers are the ratio between the demand for and the price of waste paper and waste cardboard, and the requirements regarding the maximum and minimum proportion of paper in the sorted cardboard and, conversely, regarding the maximum and minimum proportion of cardboard in the sorted paper.

The positions of all but one of the shafts 7 of each conveyor 1, 2 are adjustable relative to the other shafts 7 in the conveying direction 8.

By adjusting the position of the shafts 7 relative to each other in the conveying direction, the size in the conveying direction of the spacing between the respective shaft 7 and next successive and/or preceding shafts 7 can be changed as well. By increasing the size of a spacing, material of a generally larger maximum size and stiffness is allowed to fall through the interspace, i.e. less paper will reach the third discharge conveyor 6 and more cardboard will reach the first and second discharge conveyors 4 and 5. By decreasing the size of a spacing, material of a generally smaller minimum size and stiffness is precluded from falling through the interspace, i.e. more paper will reach the third discharge conveyor 6 and less cardboard will reach the first and second discharge conveyors 4 and 5.

Thus, also the spacings in the conveying direction can be accurately adjusted to the characteristics of the mixture of paper and cardboard material fed to the sorting conveyors 1, 2. It is noted that the adjustability of the positions of the shafts 7 in the conveying direction is also advantageous if the impellers are arranged on the shafts in fixed positions, but that in combination with the lateral adjustability of the spacings between the impellers 9, particularly good sorting results can be achieved, probably because the dimensions of the spacings between the impellers in both longitudinal and transverse direction are adjustable to the size and flexibility distributions of paper and cardboard in the material to be sorted.

Because the positions of each of the adjustable shafts 7 of each of the conveyors 1, 2 relative to the respective other shafts 7 are independently adjustable in the conveying direction 8, it is possible not only to adjust the spacing between successive shafts 7, but also to vary the spacings as a function of the distance in the conveying direction along the conveyors, depending on the structure of the materials to be sorted.

In most cases, it is preferred that the size of the spacings in longitudinal and transverse direction between impellers and shafts generally increases in the conveying direction. Thus, the spacings encountered by material fed to the upstream conveyor track 1 are initially relatively small, so that, at first, the very small items are sorted out while keeping the amount of cardboard dropping through to a minimum. After the material has travelled some distance along the conveyor track, the larger and stiffer items generally have assumed positions where they lie essentially flat on the conveyor track 1. In such positions, the cardboard items can pass larger spacings with little or no likelihood of falling through, so that by increasing the size of the spacings as a function of the distance travelled by the passing material at the respective spacing, an increased paper yield can be obtained without sacrificing the degree of purity of the sorted paper. The same principle applies to the downstream conveyor 2.

Each of the sorting conveyors 1, 2 is constituted by an upstream section 29 and a downstream section 30. The mutual spacings between the shafts 7 in the upstream sections 29 and between the shafts 7 in the downstream sections 30 are independently adjustable. Since the upstream and downstream sections 29, 30 of each of the sorting conveyors 1, 2 are driven by separate chains 14, the circumferential velocities of the shafts 7 in each of the upstream and downstream sections are controllable independently of each other. Thus, the circumferential velocity of the impellers 9 in each section can be controlled in accordance with the size in the conveying direction of the spacings between the shafts 7 and the impeller plates 9. Preferably, a higher circumferential velocity is selected if larger spacings in the conveying direction are set. Increasing the circumferential velocity in the downstream direction further provides the advantage that items on the sorting conveyor are urged apart when reaching downstream sections, increasing the likelihood that smaller items pass through widened gaps between the larger items.

The transmission wheels 13 are positioned in a row. The divert wheels 15, which are rotatable as well, are arranged along the row of transmission wheels 13 in staggered relation to the row of transmission wheels 13. The drive chain 14 is woven alternately over the transmission wheels 13 and the divert wheels 15. This transmission structure allows the shafts 7 carrying the impellers 9 to be displaced in the conveying direction over substantial distances without requiring structural changes to the transmission structure or even repositioning of the divert wheels 15. A particularly efficient construction is obtained because the divert wheels 15 are mounted on a support structure in fixed positions.

Figure 7:
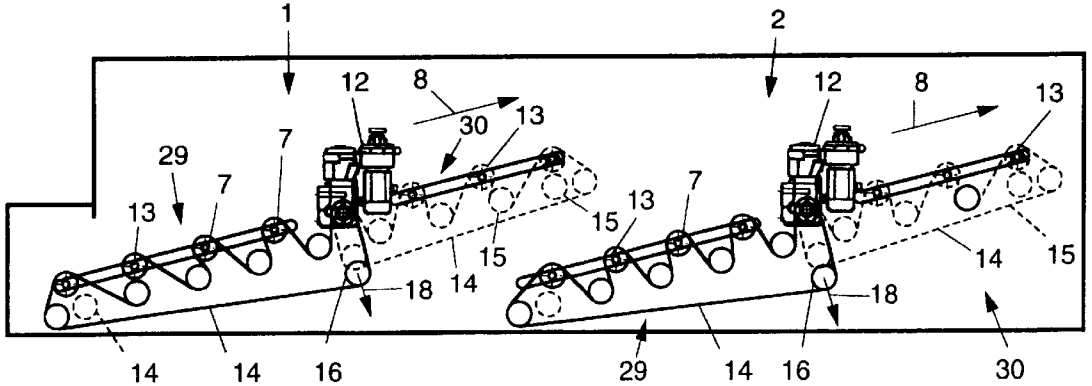
FIG. 7 is a view according to FIG. 6 in a setting corresponding to the setting shown in FIG. 2.

It is noted that the upstream sections of the upstream conveyor 1 in FIGS. 1 and 6 have five shafts 7, whereas the corresponding sections in FIGS. 2 and 7 have only four shafts 7. By allowing the removal of shafts 7, the spacing between successive shafts along a given track can be widened further than if adjustments are restricted to adjustments of a fixed number of shafts along that track. The chain 14 in the upstream parts of the upstream conveyors 1 in FIGS. 2 and 7 is woven to by-pass the most upstream divert wheel 15 which is shown in dotted lines. Depending on the selected setting and the length of the chain 14, various manners of leading the chain 14 over the divert wheels 15 and the transmission wheels 13 are available.

In the drawings, the upstream sections of both conveyors 1, 2 are shown in a setting in which the chain skips a divert wheel 15 as well. The spare divert wheels 15 allow mounting an additional shaft. In other settings, skipping a divert wheel 15 other than the most downstream divert wheel 15 can be advantageous.

To allow adjustment of the positions of the shafts 7 in the conveying direction, bearing members 19 of the shafts 7 are releasably mounted onto rails 20 extending along the conveyors 1, 2 in the conveying direction 8. The rails 20 are provided with a row of holes along the length of the rails 20. By inserting bolts through the bearing member 19 and through selected holes, the bearing members 19, and hence the shafts 7, can be inserted fixedly in the desired positions. It will be evident that many other constructions for adjustably positioning the shafts are feasible, such as clamping the bearing members onto the rails.

To prevent waste material from leaving the conveyors in lateral direction, the conveyors 1, 2 are provided with guide plates 21. To allow adjustment of the shafts 7 without disassembling the guide plates 21, slots 22 are provided in the guide plates 21. The slots 22 in turn are resiliently closed off by brushes 23 which prevent waste material from falling through the slots 22, but do not interfere with adjustment, removal or addition of any of the shafts 7. To facilitate driving the conveyor from the motor-transmission units 12, which are in fixed positions, one of the shafts 7 of each of the conveyors 1, 2 is mounted in a fixed position.

Since the shafts 7 in fixed positions are central shafts 7 located between upstream and downstream shafts 7 in adjustable positions, a given readjustment of the spacings between the shafts 7 entails relatively small maximum displacements of the shafts 7. If, for example, the fixed shaft were positioned at an extreme end of the conveyor, a given proportional readjustment would for example require a displacement of the shaft at the opposite end of the conveyor about twice as large as the displacement of the shafts 7 at the extreme ends of conveyors 1, 2 with central fixed shafts 7.

An efficient and compact construction of the conveyor is further promoted by arranging the motor-transmission units 12 close to the fixed shafts 7 and particularly by providing a direct drive from the reduction transmission of the unit 12 to the respective fixed shaft 7.

Figure 8:
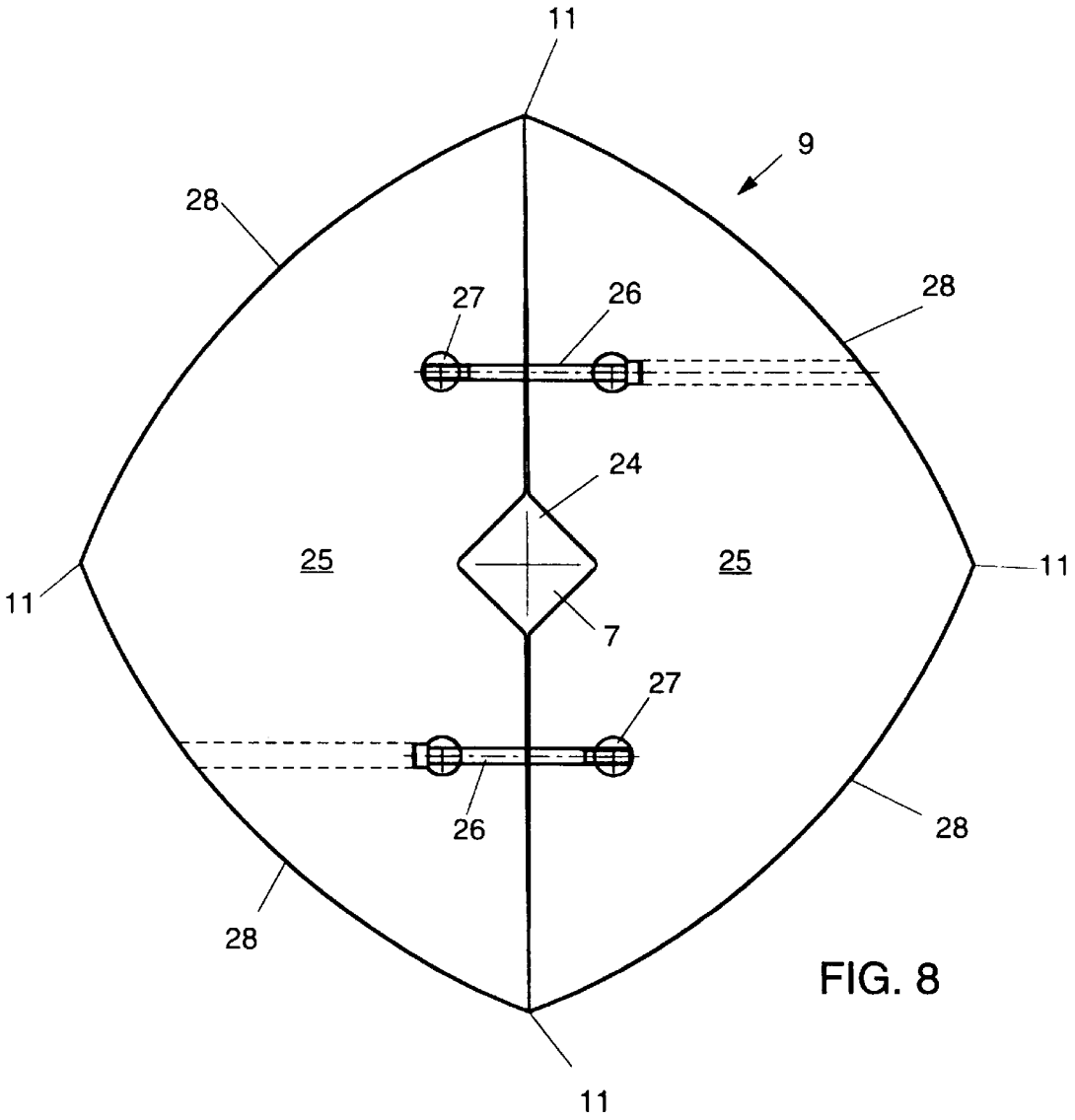
FIG. 8 is a detailed side view of an impeller member of the sorting conveyor system shown in FIGS. 1–7.

As is best seen in FIG. 8, the impellers 9 are releasably clamped onto the shafts 7, which are preferably of polygonal cross section. This allows easy readjustment of the lateral spacing between successive impellers 9 of a row. Thus, not only the spacing in the conveying direction, but also the lateral spacing between successive impellers 9 can be easily adjusted to the properties of the material to be sorted and to requirements regarding the sorted materials. The latter advantage can also be obtained if clamped impellers of the above-described type are applied in a sorting conveyor of which the shafts carrying the impellers are not adjustable.

Furthermore, the impellers 9 are each provided with an opening 24 through which extends the shaft 7 carrying that impeller. A releasable part 25 is displaceable when in released condition. When the releasable part 25 is in displaced condition, a radial passage for passing the shaft 7 radially into and out of the opening 24 is obtained. This construction of the impellers allows the impellers 9 to be mounted on and dismounted from the shafts 7 without dismounting the shafts 7. Thus, if damage to an impeller 9 or readjustment of the lateral spacing between the impellers 9 necessitates mounting or dismounting impellers 9, impellers 9 can be dismounted from the shaft 7 and mounted on the shaft 7 without dismounting the shaft 7 or requiring a shaft having a free end over which the impeller can be mounted. In particular, given the fixed width of the sorting conveyors 1, 2, lateral adjustment of the mutual, lateral spacing between the impellers 9 of a shaft 7 will generally require the removal or addition of at least one impeller plate assembly 9.

The impellers 9 of the sorting conveyors shown can be manufactured particularly efficiently, because the impeller body is formed by two mutually identical parts 25. The parts 25 are releasably clamped around the one of the shafts 7 carrying that impeller 9 through bolts 26 engaging plug-shaped nuts 27 in the opposite parts. The impeller body can also be advantageously formed by more than two identical parts clamped around the shaft.

Figure 5:
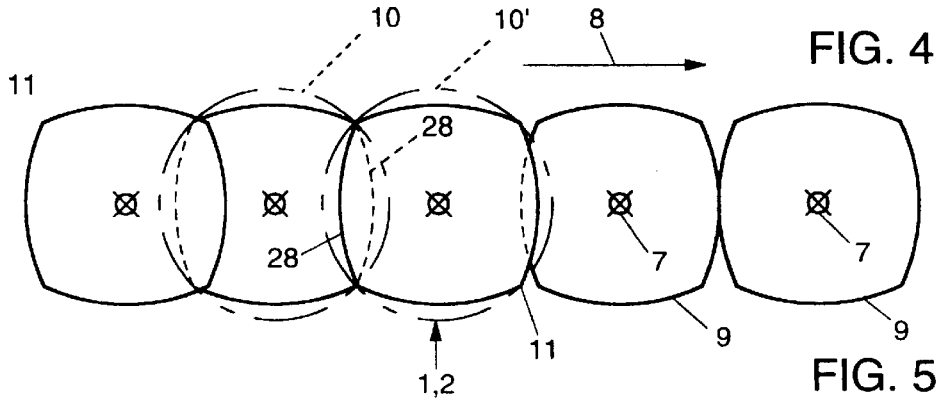
FIG. 5 is a side view according to FIG. 4 with impellers in different rotary positions.

The contour of the impellers 9 with radially outwardly projecting corners 11 and outwardly curved sections 28, with the corners 11 projecting further outward than at least adjacent portions of the curved sections 28, is advantageous in that, on the one hand, it generates a substantial intermittent vertical motion of the material lying on the bed formed by the impellers 9 when the impellers 9 are rotated but, on the other, it provides a relatively large minimum overlap between impellers 9 carried by successive shafts 7. Furthermore, when impellers 9 carried by successive shafts 7 are in orientations in which the curved sections 28 face each other, as shown in FIG. 5, relatively steep wedge-like sloping edges of the interspaces between successive shaft-impeller assemblies are obtained, which cause any material tending to fall through that interspace to be gradually urged in a flexed condition allowing passage through that interspace. To prevent even small, but stiff cardboard items from falling through interspaces between successive rows of impellers 9, the spacings between successive shafts 7 are preferably set such that impellers 9 of neighboring shafts 7 mutually overlap in each rotary position of the respective impellers 9.

What is claimed:

1. A waste paper sorting conveyor for sorting waste paper from waste cardboard, comprising a row of rotatable, driven shafts mutually spaced in a conveying direction and each extending transversely to said conveying direction, said shafts each carrying a row of radially extending impellers for intermittently urging material on the sorting conveyor upward and in the conveying direction, the impellers of each of said rows being mutually spaced in longitudinal direction of the respective shaft, where the impellers of at least one of said rows are releasably fixed to the respective one of said shafts for allowing repositioning of the impellers of said at least one of said rows in longitudinal direction along the respective shaft while said impellers are mounted in released condition.

2. A sorting conveyor according to claim 1, wherein said impellers are releasably clamped onto the shafts.

3. A sorting conveyor according to claim 1, wherein at least one of said impellers is provided with an opening through which extends the shaft carrying that impeller, with a releasable part displaceable when in released condition, and with a radial passage for passing said shaft radially into and out of said opening when said releasable part is in displaced condition said at least one of said impellers comprising at least two releasably connected parts, said parts bounding opposite sides of said opening and clamping said at least one of said impellers to said shaft.

4. A sorting conveyor according to claim 1, wherein at least one of said impellers includes at least two mutually identical parts, said parts bounding opposite sides of an opening in said at least one impeller through which extends one of said shafts carrying said at least one impeller and being clamped around said one of said shafts carrying said impeller.

5. A sorting conveyor according to claim 1, wherein the position of at least one of said shafts relative to the other shafts is adjustable in conveying direction.

6. A sorting conveyor according to claim 5, wherein the positions of each of at least two of said shafts relative to the respective other shafts are independently adjustable in conveying direction.

7. A sorting conveyor according to claim 5, wherein mutual spacings between said shafts in an upstream section and a downstream section are independently adjustable and wherein circumferential velocities of the impellers of each of said sections are adjustable independently of the circumferential velocities of the impellers of the other one of said sections.

8. A sorting conveyor according to claim 5, wherein each of said spacings between a neighboring pair of said shafts is equal to or smaller than any next successive one in conveying direction of said spacings between a neighboring pair of said shafts.

9. A sorting conveyor according to claim 1, wherein at least one of said shafts is rotatably mounted in a fixed position.

10. A sorting conveyor according to claim 9, wherein said shaft in a fixed position is a central shaft located between upstream and downstream shafts in adjustable positions.

11. A sorting conveyor according to claim 9, further comprising a drive unit arranged closely adjacent said fixed shaft.

12. A sorting conveyor according to claim 1, wherein said impellers each have a contour which has at least one radially outwardly projecting corner and at least one outwardly curved section, said corner projecting further outward than at least adjacent portions of said curved section.

13. A sorting conveyor according to claim 12, wherein impellers of neighboring shafts mutually overlap in each rotary position of the respective impellers.

14. A waste paper sorting conveyor for sorting waste paper from waste cardboard, comprising a row of rotatable, driven shafts mutually spaced in a conveying direction and each extending transversely to said conveying direction, said shafts each carrying a row of radially extending impellers for intermittently urging material on the sorting conveyor upward and in the conveying direction, the impellers of each of said rows being mutually spaced in longitudinal direction of the respective shaft, where the impellers of at least one of said rows are releasably fixed to the respective one of said shafts for allowing readjustment of the mutual spacing of the impellers of said at least one of said rows in longitudinal direction along the respective shaft while said impellers are mounted in released condition, wherein the position of at least one of said shafts relative to the other shafts is adjustable in said conveying direction, and wherein at least a plurality of said shafts each carry a transmission wheel, said transmission wheels being positioned in a row, a row of rotatable divert wheels are arranged along said row of transmission wheels in staggered relation to said row of transmission wheels, and a drive belt or chain is woven alternately over said transmission wheels and said divert wheels, and at least a plurality of said shafts is supported by at least one common guide and adjustable in said conveying direction relative to the other shafts along said at least one common guide.

15. A sorting conveyor according to claim 14, wherein said divert wheels are rotatably mounted in fixed positions.

16. A waste paper sorting conveyor for sorting waste paper from waste cardboard, comprising:

a row of rotatable, driven shafts mutually spaced in a conveying direction and each extending transversely to said conveying direction, said shafts each carrying a row of radially extending impellers for intermittently urging material to be sorted upward and in said conveying direction, the impellers being mutually spaced in a longitudinal direction along each shaft, wherein at least a plurality of said shafts each carry a transmission wheel, said transmission wheels being positioned in a row, a row of rotatable divert wheels are arranged along said row of transmission wheels in staggered relation to said row of transmission wheels, and a drive belt or chain is woven alternately over said transmission wheels and said divert wheels, and wherein at least a plurality of said shafts is supported by at least one common guide and the position of at least a plurality of said shafts relative to the other shafts is adjustable in said conveying direction along said at least one common guide.

17. The waste paper sorting conveyor of claim 16, wherein the impellers are spacially adjustable in the longitudinal direction relative to one another.

* * * * *